United States Patent [19]

Fischer

[11] Patent Number: 4,997,105

[45] Date of Patent: Mar. 5, 1991

[54] GLOVE DISPENSING SYSTEM

[75] Inventor: Dan E. Fischer, Sandy, Utah

[73] Assignee: Ultradent Products, Inc., Salt Lake City, Utah

[21] Appl. No.: 212,526

[22] Filed: Jun. 28, 1988

[51] Int. Cl.[5] ..... B65D 85/18

[52] U.S. Cl. ..... 221/45; 221/59; 221/63; 221/302; 221/305; 221/67

[58] Field of Search ..... 221/45, 46, 56–60, 221/63, 285, 305, 302, 67; 206/278, 438

[56] References Cited

U.S. PATENT DOCUMENTS

| | | | |
|---|---|---|---|
| 282,785 | 8/1883 | Schoof | 221/59 X |
| 1,362,449 | 12/1920 | Teall | 221/45 |
| 1,692,463 | 11/1928 | Merrin | 221/285 X |
| 1,730,074 | 10/1929 | Horwitt | 221/67 X |
| 1,910,094 | 5/1933 | Crane et al. | 221/45 |
| 2,923,435 | 2/1960 | Chaplin | 221/56 X |
| 3,178,054 | 4/1965 | Lindecker | 221/58 |
| 3,243,079 | 3/1966 | Rettmer | 221/63 |
| 3,326,450 | 6/1967 | Langdon . | |
| 3,343,716 | 9/1967 | Peebles | 221/46 |
| 3,383,012 | 5/1968 | Adell | 221/46 |
| 3,596,798 | 8/1971 | Smith | 221/56 |
| 3,784,055 | 1/1974 | Anderson | 221/46 |
| 4,099,614 | 7/1978 | Heissenberger . | |
| 4,269,315 | 5/1981 | Boyce | 206/278 X |
| 4,515,270 | 5/1985 | Alvarado . | |
| 4,586,631 | 5/1986 | Loder | 221/58 |
| 4,673,084 | 6/1987 | Hubbard et al. . | |
| 4,677,697 | 7/1987 | Hayes . | |

FOREIGN PATENT DOCUMENTS

| | | | |
|---|---|---|---|
| 0251103 | 1/1988 | European Pat. Off. | 221/45 |

*Primary Examiner*—F. J. Bartuska

*Attorney, Agent, or Firm*—Workman, Nydegger & Jensen

[57] ABSTRACT

The present invention provides a device for storing a plurality of gloves and for individually dispensing the gloves. The invention allows a user to easily retrieve a single glove while the remaining gloves are shielded from contamination by the user and from the surrounding environment. The present invention includes a container having a dispensing aperture formed thereon. A plurality of gloves is disposed within the container. A shield is provided to cover the aperture when a glove is not being retrieved. A hinge, or other structure, is provided which allows a user to move the shield to an open position when retrieving a glove and which will return the shield to a closed position upon removal of the user's hand. The present invention has particular advantages in environments such as dental offices and other locations where contaminants may be present and where it is necessary to protect the stored gloves from such contaminants until a glove is dispensed.

29 Claims, 4 Drawing Sheets

GLOVE DISPENSING SYSTEM

BACKGROUND

1. The Field of the Invention

The present invention pertains to delivery systems used to store and dispense gloves. More particularly, the present invention is directed to a system for dispensing gloves in environments such as health care setting or the food processing industry where the cleanliness of the outer surface of the glove must be maintained until the glove is dispensed.

2. The Prior State of the Art

Gloves have become essential in the practice of modern health care procedures. Medical personnel such as surgeons, nurses, and dentists working in settings such as emergency rooms, hospitals, dental offices, and in the case of paramedics, in public places as well as other similar environments, are all routinely required to wear gloves as they work, particularly if there is any risk of contact with a patient's body fluids. The gloves which are typically used are fabricated from latex or a plastic such as polyethelene or vinyl and are disposed of after a single use.

Generally, latex gloves used in the health care field are elastic and assume a "skin tight" fit when donned. In contrast, gloves fabricated from materials such as polyethelene, which are often used in the food processing field, remain "loose" after being donned. Both types of gloves are also used by industry in applications such as clean room environments, food processing plants, and in other environments where protection of workers and/or products from contamination is necessary.

In light of growing concernig over the spreading epidemic of acquired immune deficiency syndrome (AIDS), it is more important than ever for health care professionals to stop the spread of disease from an infected patient to the attending professional. This is in addition to the long recognized need to prevent transfer of infectious organisms from the hands of the attendant to the patient. Thus, health care professionals have adopted the practice of donning, removing, and donning new gloves much more often than previously thought necessary in order to protect themselves from infection as well as to protect their patients from cross-contamination.

For example, dentists often employ several assistants who will each be simultaneously preparing a patient for the dentist's attention. Disadvantageously, as the dentist circulates among the patients the dentist must change gloves each time a different patient is examined. Moreover, each of the assistants must change their gloves as they begin to examine each patient. Thus, it is common to find a supply of gloves located at each work area in the office.

Significantly, the outer surface of gloves worn by a dentist or by workers in a clean room environment must be clean but not necessarily sterile. In contrast, gloves used in an operating room must be sterile and extensive precautions are taken to ensure that the outer surface of the glove remains sterile.

Precautions taken to ensure the sterility of gloves includes individually packaging each pair of gloves in a sterile sealed container to be opened only just as the gloves are donned in the operating room. While dentists and other users of "clean gloves" could utilize individually packaged sterile gloves, the cost of doing so is prohibitive except in those circumstances where sterility must be guaranteed.

Since sterility of the gloves is not required in many applications, it has been common in the past to package, for example, one hundred "latex examination gloves" in ordinary paper boxes which are sold to dentists and other health care providers. Generally, the box is opened by removing its top. The box is then left open in the work area. Gloves dispensed from such "open boxes" are generally haphazardly arranged in the box. The open box full of gloves usually sits on a countertop within easy reach of the user. When a glove is needed the user merely reaches into the box and pulls out one or more gloves.

The open box method of dispensing gloves inherently has several disadvantages. Foremost, the gloves are constantly exposed to contamination from the surrounding environment. In the dentist's office, the gloves may be showered with water from hand washing procedures. More importantly, routine dental procedures such as cleaning teeth or filling a cavity may cause debris, including the patient's saliva and blood, to be scattered around the work area into the open container of gloves.

Even when contamination by patients' body fluids is not a concern, the open box full of gloves is exposed to airborne dust and microorganisms which settle onto the gloves. Moreover, the gloves dispensed by way of an open box become soiled as users reach into the box and make contact with a number of gloves before retrieving the one glove which will be donned.

In view of the foregoing, it would be an advance in the art to provide a glove dispensing system which would allow a person to easily retrieve a single glove from a container full of gloves while keeping the remaining gloves clean. It would also be an advance in the art to provide a glove dispensing system which would shield gloves from contamination by the surrounding environment when a glove is not being retrieved.

It would be a further advance in the art to provide a glove dispensing system which is relative inexpensive to manufacture, easy to use, and which may be disposed of after use. It would be a still further advance in the art to provide a glove dispensing system in which gloves may be transported to the user and stored until ready for use.

OBJECTS AND BRIEF SUMMARY OF THE INVENTION

In view of the present state of the art, it is a primary object of the present invention to provide a system for conveniently dispensing gloves while maintaining the cleanliness of the gloves until they are dispensed.

It is another object of the present invention to provide a glove dispensing system which is inexpensive to manufacture and which may be disposed of after use.

It is a further object of the present invention to provide a glove dispensing system which allows a plurality of gloves to be transported, stored in, and dispensed from, the same container.

Additional objects and advantages of the present invention will become apparent during an examination of the description which follows or by the practice of the invention.

Consistent with the forgoing objects, the present invention provides a glove dispensing system which allows a user to conveniently retrieve a glove from a container holding a plurality of gloves while keeping the remaining gloves clean. The present invention comprises a container means which preferably approximates a box-like structure. A plurality of gloves are disposed within the container and are one-by-one presented to the user.

A dispensing aperture or other dispensing means is provided on the container to allow a user to remove a glove from the interior of the container. Importantly, a shield means or other cover structure is provided to shield the dispensing aperture and the gloves from contamination by the surrounding environment. Cooperating with the shield or cover is a means for allowing the shield to move to a closed position immediately after the user has removed a glove. Thus, after a glove is removed from the container by a user, the shield covers the dispensing aperture to prevent contamination of the remaining gloves.

In order to facilitate transportation and storage of the device incorporating the present invention and the gloves contained therein, the shield is preferably sealed closed until opened by the user. A mechanism may also preferably be included in embodiments of the present invention to push the gloves toward the dispensing aperture thus always keeping a glove ready for retrieval by the user.

BRIEF DESCRIPTION OF THE DRAWINGS

In order to more fully understand how the above-mentioned objects of the invention are achieved, a more particular description of the invention will be provided by reference to specific embodiments which are illustrated in the accompanying drawings. It is to be understood that these drawings depict the presently preferred embodiments of the invention and are not to be considered as limiting the scope of the invention. The best mode of carrying out the invention will be described in detail using the accompanying drawings, in which.

DETAILED DESCRIPTION OF THE PREFERRED EMBODIMENTS

Figure 1:
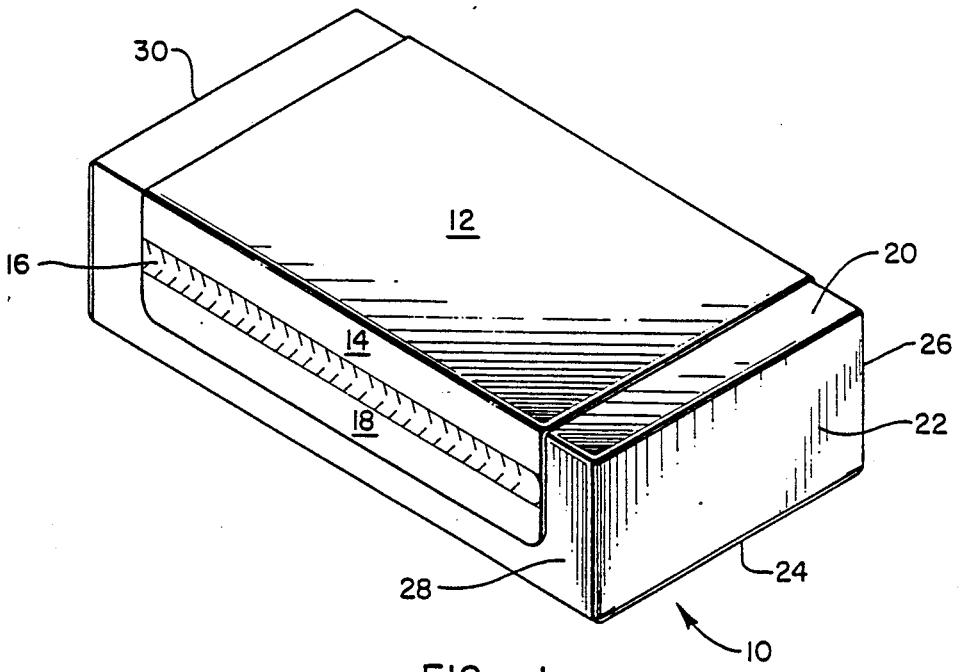
FIG. 1 is a perspective view of a first presently preferred embodiment of the invention which is sealed and ready to be transported to, and stored by, the user.

Reference will now be made to the drawings wherein like structures are provided with like reference numerals.

In this description of the preferred embodiments, terms such as "top and bottom," "upper and lower," and "front and rear" will be used for ease of reference to the illustrated structures. However, such adjectives are used in reference to the orientation of the figures and in actual practice the structures of the embodiments may assume a different orientation.

In FIG. 1, a perspective view of a first presently preferred embodiment of the present invention is provided. The apparatus generally comprises a rectangular box-shaped container, generally designated 10, having a top 20, bottom 24, front 28, back 26, and first and second ends, 24 and 30. While not illustrated in the drawings, other configurations for the container are contemplated to be within the scope of the present invention.

Container 10 may preferably be fabricated from one of several appropriate paper materials known to those skilled in the art. Generally, a paper material which has been treated to obtain a smooth, hard surface will desirably resist deterioration due to contact with fluids. Also, the material must be strong enough to resist buckling or tearing during use. It is also within the scope of the present invention to utilize other materials, such as plastics, to form container 10. A more complete description of the preferred structure of the container will be provided in connection with FIG. 4.

The length and width of container 10 preferably should be slightly more than the overall length and width of the gloves to be contained therein. Generally, gloves are packed into container 10 stacked flatly upon one another as will be discussed more fully shortly in this disclosure. Even though gloves are available in a range of sizes, e.g., small, medium, and large, it is generally preferable to fabricate container 10 to accommodate the largest glove to be dispensed and the same embodiment will generally work in a very satisfactory manner with smaller-sized gloves.

The height of container 10 may be chosen to accommodate the maximum number of gloves to be packed into the container. Of course, container 10 should not be so large so as to be an obstruction in the work place. Also, if a large number of gloves are to be packed into a large container, it may be desirable to fabricate the container from a sturdier material since the container will be subjected to more wear due to a larger number of glove retrievals.

The embodiment illustrated in FIG. 1 is represented as it would be after the manufacture thereof is complete, gloves have been packed therein, and shield 12 has been sealed closed ready for transportation and sale. As can be seen in FIG. 1, shield 12 is sealed in a closed position by utilizing flap 14, tear strip 16, and seal strip 18 whose function can be best explained by reference to FIG. 2.

Figure 2:
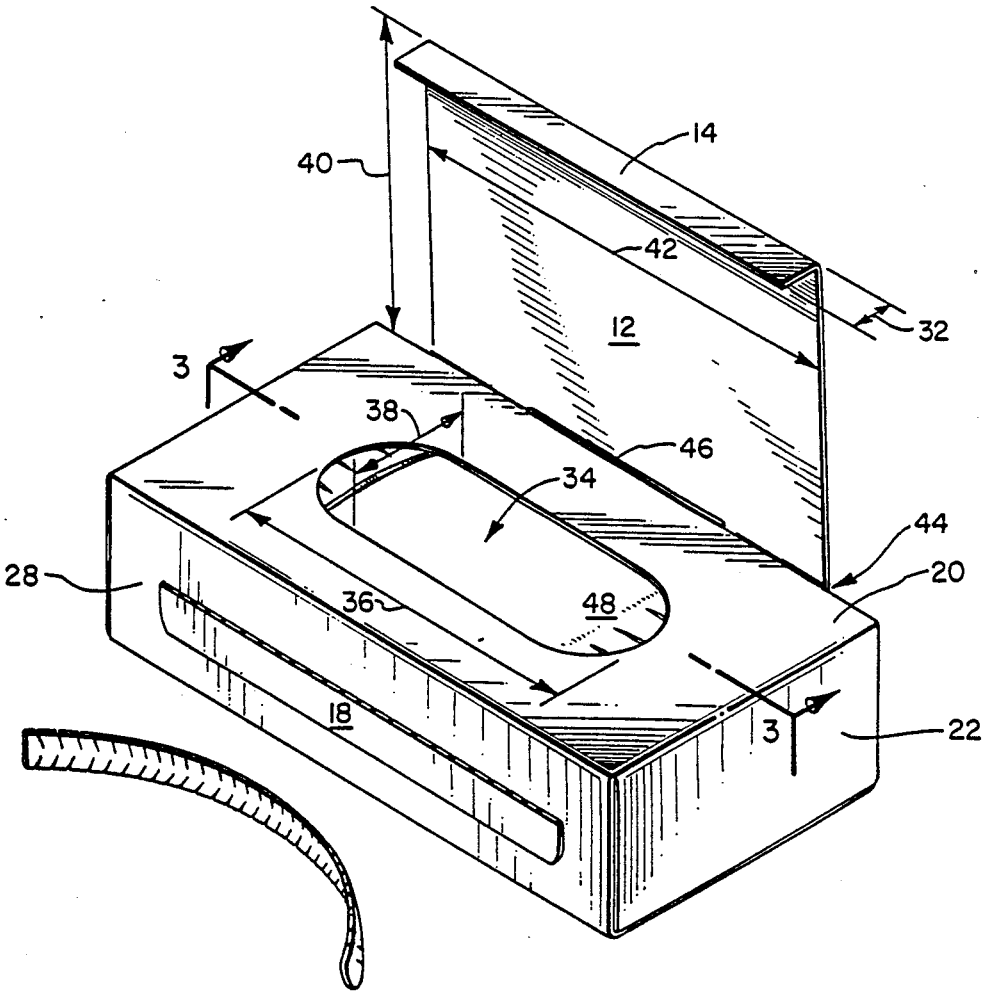
FIG. 2 is a perspective view of the first embodiment illustrated in FIG. 1 with the seal broken and the shield in an open position to allow retrieval of a glove.

FIG. 2 illustrates the embodiment of FIG. 1 with tear strip 16 removed thus unsealing and freeing shield 12 which is shown in its opened position. It should be noted that tear strip 16 illustrated in the figures is just one of the several schemes known to those in the art which can be used to seal shield 12 in a closed position prior to its first use. The structure of tear strip 16 may be altered to suit the material from which container 10 and shield 12 are made. Furthermore, it may be desirable in some applications to include a resealable structure in place of, or in addition to, tear strip 16.

As illustrated in FIG. 2, top 20 of container 10 has a dispensing aperture, or dispensing means (generally designated 34) formed thereon. The shape and dimensions of aperture 34 are significant to the proper operation of the apparatus. The length (indicated by arrow 36) of aperture 34 should be short enough so that it is shorter than the smallest glove (one of which is represented at 48) to be dispensed from the container. Conversely, the length of aperture 34 must be long enough to allow the fingers of the user to easily grasp the glove. Similar considerations apply when choosing a width (indicated by arrow 38) for aperture 38. It is also generally preferred that the aperture be centered on the top of the container.

As mentioned, it is important to provide a shield to separate the gloves in the container from the contaminants found in the surrounding environment. Shield 12 (shown in FIG. 2 in an open position) and its associated structures perform this function while allowing easy retrieval of gloves from the interior of the container. Importantly, shield 12 assumes a closed position (with shield 12 against top 20) whenever a glove is not being retrieved.

The length of shield 12 (indicated by arrow 40) should be at least somewhat longer than the length of dispensing aperture 34 to ensure that all of the aperture is covered when the shield is in the closed position. Also, it is preferred that shield 12 be as wide as the container so that flap 14 extends over the front edge of the container.

Shield 12 may preferably be fabricated as a unitary structure with container 10 and be provided with a joint structure represented generally at 44. Alternatively, shield 12 may be formed from a separate piece and joined to container 10 by a hinge structure.

Figure 3:
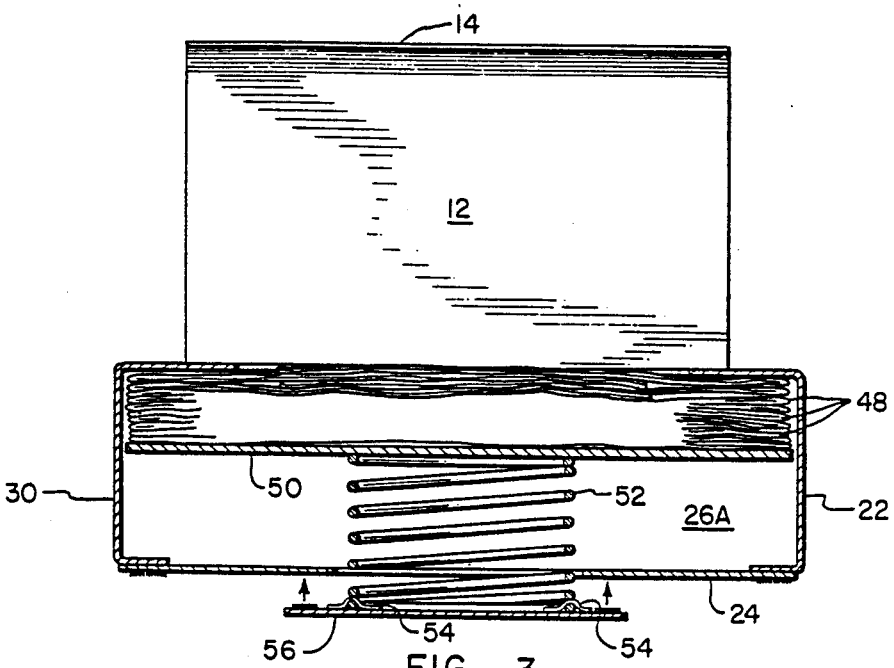
FIG. 3 is a cross-sectional view of the first embodiment illustrated in FIG. 2 representing one preferred structure for the glove push-up mechanism.
Figure 4:
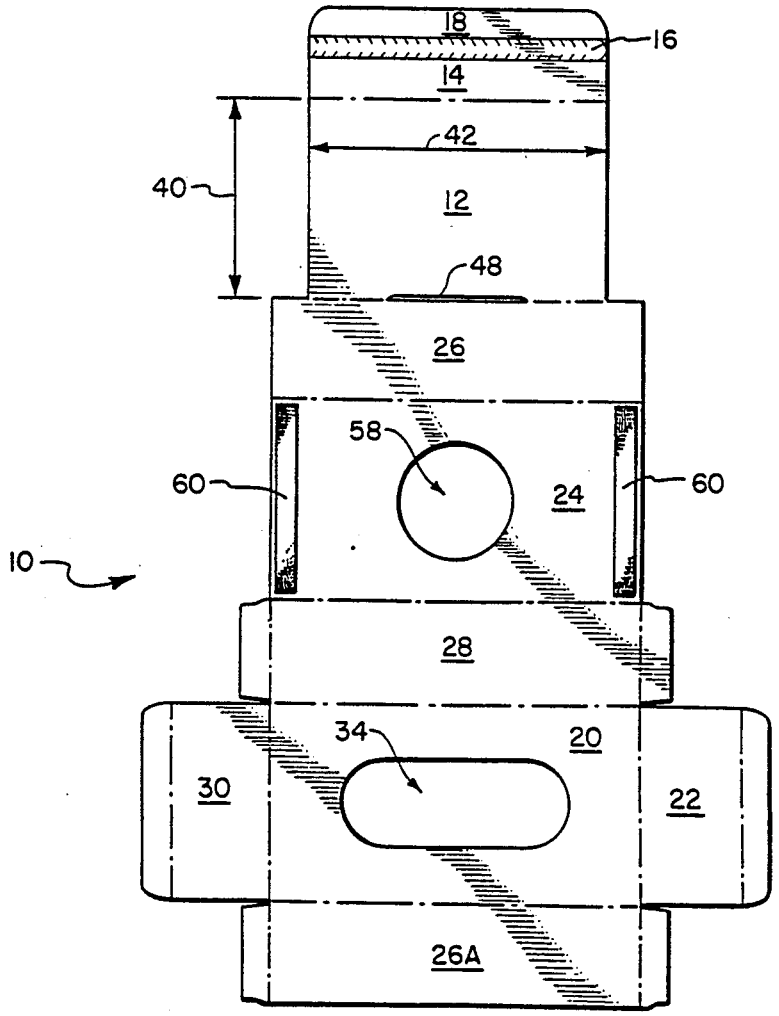
FIG. 4 is a plan view of the container of the first embodiment illustrated in FIG. 1 which has been cut from a single sheet of material and is ready to be folded and assembled.

In the illustrated embodiment, shield 12 is integral with the remainder of container 10 as will be fully explained shortly in connection with FIG. 4. Hinge 44, which functions as a means for moving the shield to a closed position, is formed by scoring or creasing the area which is to form the joint. Importantly, in the embodiment illustrated in FIGS. 1–4, an area of the hinge is provided with an incision or cut out portion, as indicated at 46, to allow the shield to quickly return to a closed position. As the cut out area 46 increases in size, the stiffness of the hinge will decrease.

The stiffness of the shield hinge must be low enough so that even when the illustrated apparatus is first used, shield 12 will fall into a closed position immediately after a user has retrieved a glove. To achieve this end, front flap 14 may be widened (i.e., increase the dimension shown at 32) in order to increase the weight on the front side of shield 12. Thus, it is possible to ensure that the force of gravity is sufficient to bring shield 12 down to the closed position quickly. It is, however, within the scope of the present invention to utilize other or additional structures to ensure closure of shield 12.

Increasing the width of front flap 14 also ensures that even if shield 12 does not immediately return to a fully closed position, contaminants in the surrounding environment will be blocked from entering directly under the shield along the front edge of the container. Likewise, it will be appreciated that lengthening shield 12 (i.e., increasing the dimension indicated at 42) also decreases the possibility that contaminants (such as patients' body fluids) will contact the gloves in the container even if shield 12 does not immediately return to the fully closed position.

While it may be desirable in some applications to incorporate a more complex means for moving the shield to a closed position (e.g., use of a spring or elastic member) the illustrated embodiment is thought to work best in most applications where gloves are retrieved regularly throughout the work day. With the illustrated embodiment a user may raise the shield and retrieve a glove using a single hand. Furthermore, the low cost and ease of fabrication of the embodiment, and the effectiveness of the shield in protecting the gloves from contamination compared to previously available dispensing systems, all make the illustrated embodiment suitable for most applications.

FIG. 3 is a cross-sectional view of the embodiment shown in FIGS. 1 and 2. In particular, FIG. 3 illustrates one preferred mechanism for pushing the gloves up toward the dispensing aperture to always allow a user to easily retrieve a single glove without contacting the gloves remaining in the container. It should be appreciated, however, that embodiments of the present invention without the glove push-up feature still provide many advantages over the previously available dispensing systems.

As illustrated in FIG. 3, gloves 48 are packed within the container on top of plate 50. FIG. 3 illustrates the glove supply as being somewhat depleted to more clearly show the pertinent structures. Plate 50 may preferably be of a paper material having sufficient stiffness along both its length and its width.

As shown in FIG. 3, coil spring 52 urges plate 50 and gloves 48 toward the dispensing aperture. Those skilled in the art will be able to select an appropriate spring from those which are commercially available. Importantly, the pressure of spring 50 on the gloves should not be so great that the gloves excessively bulge out of the dispensing aperture or so that the gloves are held so tightly that they are difficult to retrieve. Spring 50 is held in place on support 56 by adhesive tape 54. Support 56, with spring 52 attached, is fastened (preferably by an adhesive) to the bottom of the container as suggested by the arrows. Preferably, support 56 and spring 52 are inserted after the container has been formed and gloves 48 and plate 50 placed inside.

Preferably gloves 48 are arranged within container 10 in an alternating stacked fashion as suggested in FIGS. 2 and 3. Since the finger portion of the glove is the portion with the greatest bulk, alternating the finger portion of the gloves as they are stacked creates a more even and more easily dispensable stack of gloves. Also, it is preferred to stack the gloves so that the edge of the cuff is showing at the dispensing aperture. With the edge of the cuff presented at the aperture, a user may retrieve a single glove by pulling upward on the cuff. This arrangement provides a convenient grasping point for the gloves and allows a user to avoid contact with the gloves remaining in the container.

FIG. 4 provides a plan view of the structure of container 10 before assembly. Preferably, container 10 is formed from a single sheet of material which is cut and scored as indicated in FIG. 4 to facilitate folding. The broken lines shown in FIG. 4 designate the locations of the scoring. Shown in FIG. 4 is hole 58 which is provided to allow spring 52 (FIG. 3) to pass therethrough. Also shown in FIG. 4 are non-skid strips 60 which may be of a resilient non-skid material. As alternatives, strips 60 may comprise adhesive strips with a peel-away covering, Velcro® fasteners, or a magnetic material for securing to steel cabinets and the like.

FIG. 4 also illustrates flap 26A which is fastened to the interior of container back 26 during the assembly procedure. It will be appreciated that the container may be assembled by adhering flap 26A to container back 26 and then gloves may then be inserted therein before one or both of sides 22 and 30 are folded closed.

Figure 5:
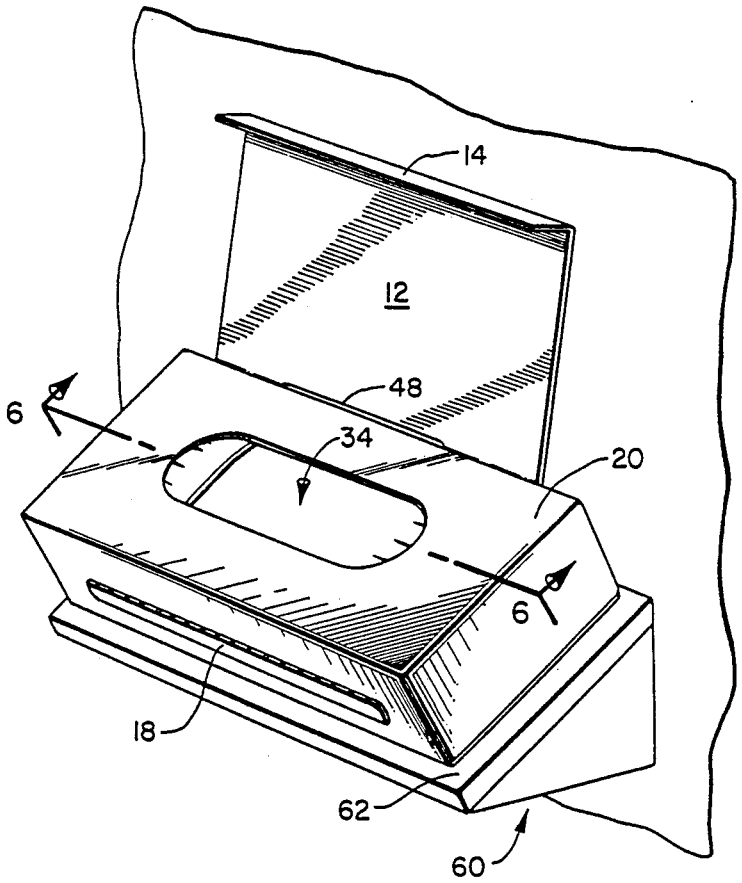
FIG. 5 is a perspective view of a second presently preferred embodiment of the present invention including a wall-mounted base whereupon the container is secured.
Figure 6:
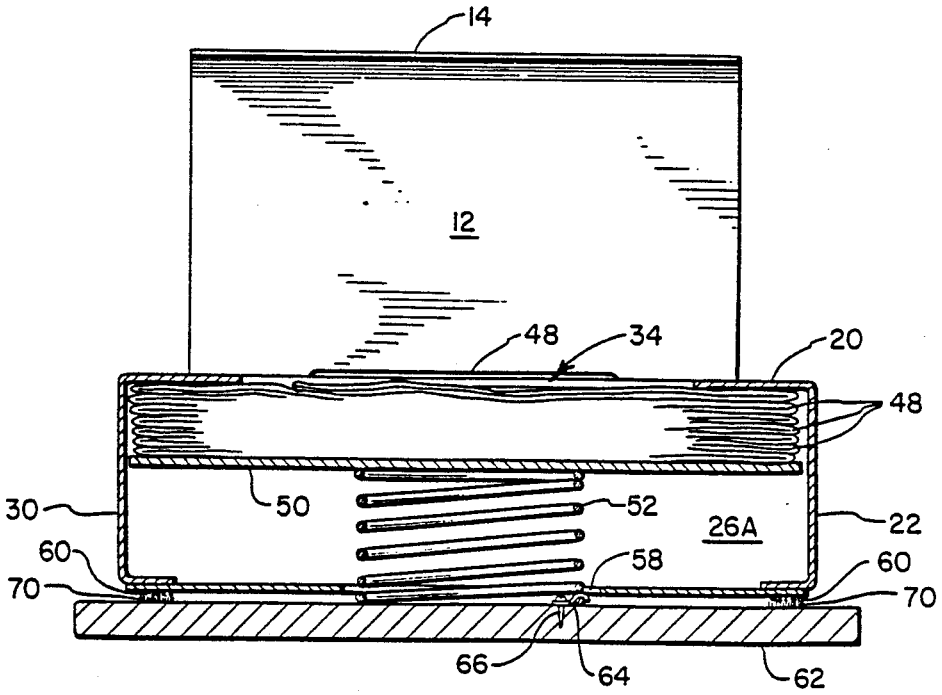
FIG. 6 is a cross-sectional view of the second embodiment illustrated in FIG. 5 representing another preferred structure for the glove push-up mechanism.

A second presently preferred embodiment of the present invention is illustrated in FIGS. 5 and 6. The embodiment illustrated in these figures shares most of the structures and features of the previously described embodiment with the inclusion of a wall-mounted stand generally indicated at 60 in FIG. 5 which serves as a permanent location from which to dispense gloves.

The embodiment illustrated in FIG. 5 retains the glove push-up feature as previously described, but coil spring 52 is attached to baseboard 62 by way of clip 64 and screw 66 as shown in the cross-sectional view of FIG. 6. In this way, the need for including a spring in each container is eliminated.

When the last glove is dispensed from a container, the container is merely removed from baseboard 62 and another full container positioned in its place. In order to hold the container against baseboard 62 against the force of the spring, it is preferred that strips 60 (shown in FIG. 4) comprise the pile component of a hook and pile fastener (such as is available under the trademark Velcro®) while baseboard 62 is provided with corresponding strips 70 of the hook component.

Figure 7:
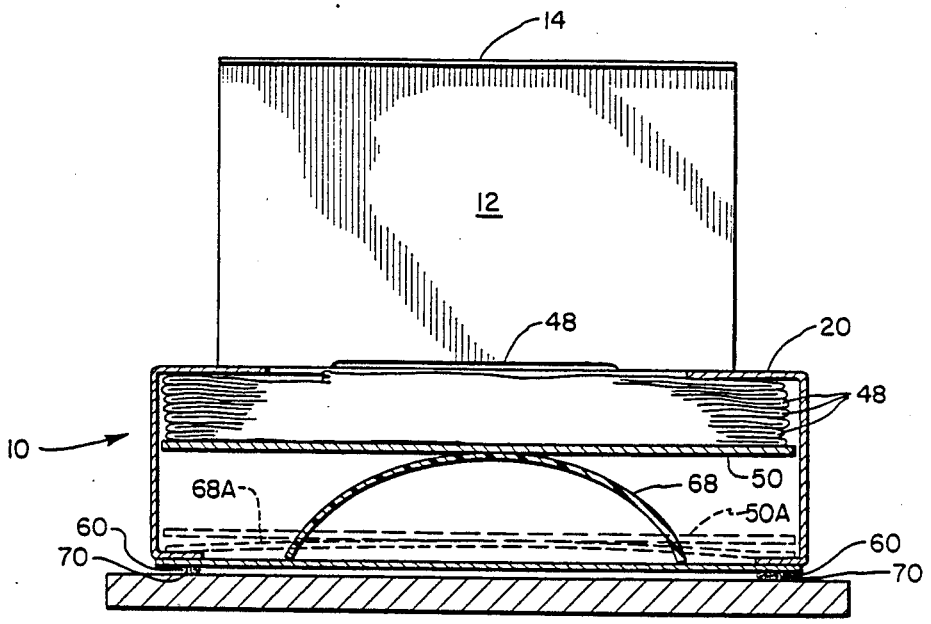
FIG. 7 is a cross-sectional view of a third presently preferred embodiment incorporating another preferred structure for the glove push-up mechanism.

A third embodiment of the present invention is illustrated in FIG. 7. The embodiment of FIG. 7 is essentially the same as the embodiment illustrated in FIGS. 1–4 except the coil spring has been replaced with a leaf spring member 68 and thus the hole provided in the bottom of the container is no longer needed and is absent from the embodiment illustrated in FIG. 7.

FIG. 7 shows leaf spring in phantom outline at 68A in a fully compressed position such as when container 10 is completely full of gloves. Correspondingly, plate 50A is also shown in a fully compressed position. Leaf spring 68 and plate 50 are also shown in a partially relaxed position.

Those skilled in the art will readily be able to select a generally available metallic or plastic material for use as leaf spring 68. When leaf spring 68 is incorporated into embodiments of the present invention it is preferred that the container be assembled and spring 68, plate 50, and the stack of gloves be inserted as a unit into an opened end of the container.

Figure 8A:
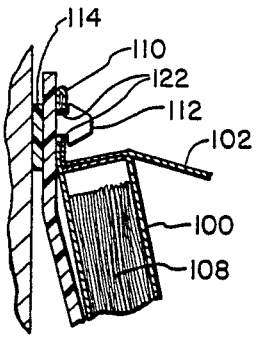
FIG. 8A is an elevated side view taken along line 8A—8A of FIG. 8.
Figure 8:
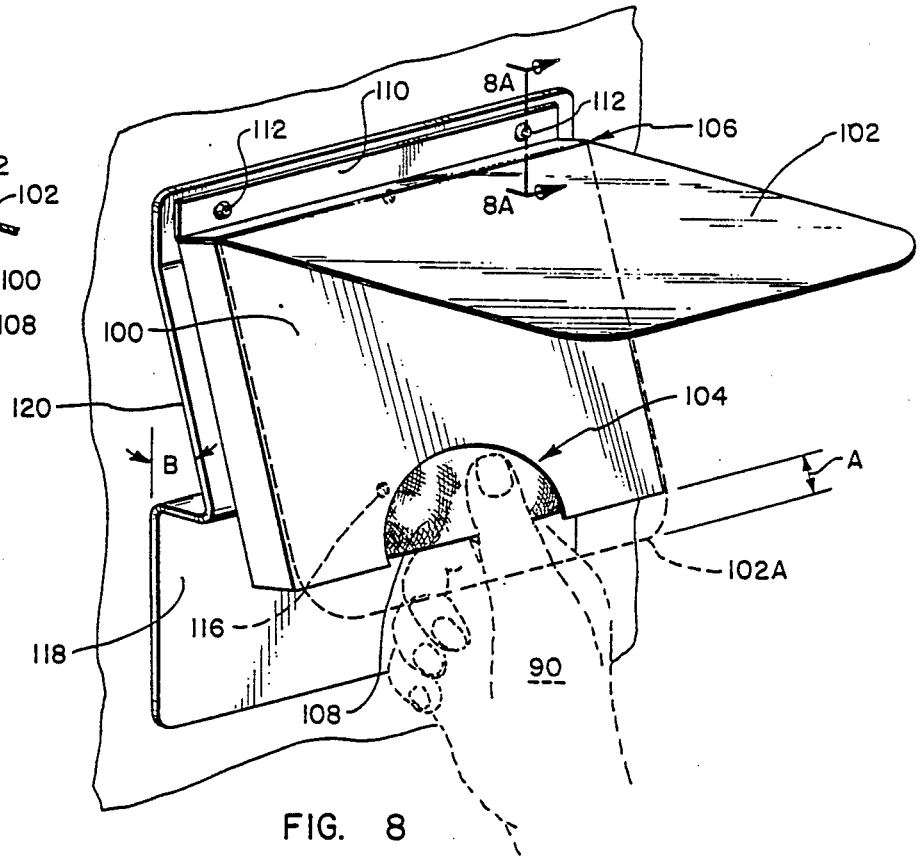
FIG. 8 is a perspective view of a fourth presently preferred embodiment which includes a wall-mounted stand whereupon the container is secured.

FIG. 8 is a perspective view of a fourth presently preferred embodiment of the present invention. While the embodiment illustrated in FIG. 8 may be used with any type of glove, it is preferred for use with polyethelene gloves which are generally thin and light weight and are easily donned and removed. Such gloves are commonly used, for example, by medical and dental professionals to quickly cover their latex examination gloves in order to avoid contaminating outer surface of the the examination glove when briefly handling objects such as telephones and writing implements.

As can be observed in FIG. 8, the fourth embodiment includes a generally box-like container 100. An aperture 104 is provided on container 100. Aperture 104 is partially disposed on the container top and partially on the container side. The semicircular shape of aperture 104 is presently preferred but other shapes may be used. Also, aperture 104 may preferably be partially disposed on the container back so that the gloves may be easily grasped using with the index finger and thumb of the user's hand which is indicated at 90 in FIG. 8. Gloves 108 are preferably folded within container 100 so that the middle back of the gloves are presented at aperture 104 to be grasped by the user.

As with the previously described embodiments, the embodiment illustrated in FIG. 8 is provided with a shield or cover 102 which, when in a closed position as shown at 102A, separates aperture 104 and the gloves exposed thereat from contamination by the surrounding environment. Cover 102 is provided with a hinge portion, generally indicated at 106, to allow a user to easily swing cover 102 to an open position. The hinge portion also allows cover 102 to move to a closed position, shown at 102A, when the user's hand is removed. Hinge portion 106 will generally operate in a satisfactory manner without an incision, as included in the previously described embodiments, but an incision may be included to ensure that cover 102 quickly and fully returns to a closed position. If an incision is not included i hinge portion 106, cover 102 may desirably not lay flat on container thus making it easier for a user to retrieve a glove.

Cover 102 should be at least as wide as thewidth of aperture 104 and preferably the same width as container 100. Moreover, it is preferred that cover 102 extend beyond the edge of the container top as shown at A in FIG. 8 to provide additional protection for aperture 104 and gloves 108 from splattering by body fluids.

As explained, while the fourth embodiment may be used with any type of glove, it has particular application or use with gloves used to cover examination gloves to prevent direct contact with objects such as telephones, writing implements, medical equipment controls, and so forth. Thus, it is advantageous to place a plurality of such embodiments in locations where the cover gloves may be needed. In order to facilitate placing the embodiments in convenient locations, a wall-mounted stand 118 is provided. Stand 118 attaches to a wall or other vertical surface by way of screws placed through holes, one of which is shown at 116 in FIG. 8, and adhesive strips, such as that shown at 114 in FIG. 8A.

Stand 118 is provided with a sloping portion 120 which is adapted to hold container 100 away from the wall to allow easy access to aperture 104 and gloves 108. The angle at which sloping portion 120 is disposed preferably is in the range from about 5° to about 40° and is represented at Angle B in FIG. 8. Of course, the container of the fourth embodiment may be used without stand 118.

FIG. 8A provides an elevated side view of a portion of the fourth embodiment. Represented in FIG. 8A is a mounting flap 110 which is flexibly attached to, or integral with, container 100. It is preferred that gloves 108 be supplied to the user in container 100 with aperture 104 being sealed. Thus, it is intended that when all of the gloves in container 100 have been dispensed, another container full of gloves is obtained and secured to stand 118.

Stand 118 is provided with two mounting posts 112 which engage mounting holes 122. The shape of mounting posts 112 allows the container to remain secured to stand 118 until the container is purposefully removed by a user to be replaced by another container. In this way, several stands 118 may be permanently located at strategic points throughout the office, such as by the telephone, etc., and as the glove supply in one container is depleted it may be easily replaced with another container full of gloves.

In view of the foregoing, it will be appreciated that the present invention provides an efficient system for storing and dispensing gloves while shielding the gloves from contact with contaminants found in the surrounding environment. Moreover, the present invention allows a user to easily retrieve a single glove without having to soil several gloves which are not retrieved. Still further, the present invention effectively shields the stored gloves from body fluids that might otherwise be splattered on the gloves in a health-care environment. Also, the present invention is relatively inexpensive to manufacture and implement and thus embodiments incorporating the invention may be disposed of after all the gloves stored therein have been dispensed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A device for storing and dispensing gloves comprising:

container means for storing a plurality of gloves, said container means comprising a wall defining an interior chamber of the container means;

dispensing means formed on the container means wall for providing a passageway through which a user may remove a glove from said interior chamber of the container means;

shield means for shielding the dispensing means from the entry of contaminants from the surrounding environment, said shield means having a closed position and an open position, the open position allowing a glove to be removed by a user from said container means through said dispensing means; and self-acting hinged means, formed as an integral part with said container means wall and comprising at least one incision through said container means wall, for returning said shield means to the closed position after a glove is removed such that the gloves are automatically shielded from contamination until removed from said container means.

2. A device as defined in claim 1 wherein said interior chamber of said shield means is releasably sealed in said closed position thereof.

3. A device as defined in claim 1 wherein said shield means comprises a flat member and said device further comprises a tearable strip sealing said flat member over said passageway.

4. A device as defined in claim 1 wherein the container means comprises a box and wherein said dispensing means comprises an aperture formed on one side of said box.

5. A device as defined in claim 1 wherein said dispensing means comprises an aperture formed through said top wall of said container means.

6. A device as defined in claim 1 wherein said shield means comprises a planar member and wherein said means for moving the shield means comprises a hinge joined between the container means and said planar member.

7. A device as defined in claim 1 wherein said container means and said shield means are fabricated from a single sheet of material.

8. A device as defined in claim 1 wherein the device further comprises a plate disposed within said container means and biasing means for pushing the plate toward the dispensing means.

9. A device as defined in claim 8 wherein said biasing means comprises a coil spring.

10. A device as defined in claim 8 wherein said biasing means comprises a curved planar section of flexible material.

11. A device as defined in claim 1 wherein said shield means comprises a planar member having a front edge and a back edge, said back edge including a hinge portion attached to the container means along one edge thereof and said front edge thereof including a flap therealong.

12. A device as recited in claim 1, wherein a portion of the perimeter of said top glove is presented at said passageway to provide a grasping point on said top glove to enable withdrawal of said top glove from said container means through said passageway.

13. A device as recited in claim 12, wherein said portion of the perimeter of said top glove presented at said passageway comprises the cuff of said top glove.

14. A device as defined in claim 1 further comprising:

a plate provided within the container means between said plurality of gloves and said bottom wall thereof;

a baseboard disposed parallel to said bottom wall of said container means;

means for releasably securing said container means to said baseboard;

a hole formed through said bottom wall of the container means; and a spring passing through said hole and being compressed between said baseboard and said bottom wall of said container means urging said plate and said plurality of gloves toward said top wall of said container means.

15. A device as recited in claim 14, wherein said spring is attached to said baseboard.

16. A device for storing and dispensing gloves comprising:

a container having a top side and a bottom side, the top side including an aperture being adapted to allow a user to retrieve at least one of a plurality of gloves from the interior of said container; and a self-acting shield associated with said container, the shield including a hinge portion formed as an integral part of the container, the hinge portion comprising a scored member and at least one incision in said hinge portion which allows said shield to be pivoted to an open position when acted upon by the user's hand, said hinge portion also acting to automatically move said shield to a closed position when the user's hand is withdrawn so that the shield covers said aperture and shields the interior of said container and the gloves contained therein from contact with contaminants when a glove is not being retrieved.

17. A device as defined in claim 16 wherein said shield is releasably sealed over said aperture.

18. A device as defined in claim 16 wherein said shield comprises a flat member and said device further comprises a tearable strip sealing said flat member over said aperture.

19. A device as defined in claim 18 wherein said aperture is smaller than the gloves disposed therein.

20. A device as defined in claim 16 wherein said container and said shield are fabricated from a single sheet of paper material.

21. A device as defined in claim 16 further comprising a plate disposed within said container and biasing means for pushing the plate toward the aperture.

22. A device as defined in claim 21 wherein said biasing means comprises a coil spring.

23. A device as defined in claim 21 wherein said biasing means comprises a leaf spring.

24. A device as defined in claim 16 wherein the shield is provided with a flap along a front edge thereof.

25. A device as defined in claim 16 further comprising:

a plate provided within the container means between said plurality of gloves and said bottom wall thereof;

a baseboard disposed parallel to said bottom wall of said container means;

means for releasably securing said container means to said baseboard;

a hole formed through said bottom wall of the container means; and a spring passing through said hole and being compressed between said baseboard and said bottom wall of said container means urging said plate and said plurality of gloves toward said top wall of said container means.

26. A device as recited in claim 25, wherein said spring is attached to said baseboard.

27. A dispenser comprising:

a box-like container having a top and a bottom;

an aperture formed on the top of said container;

a planar shield member having a length and a width at least as great as the corresponding dimensions of said aperture; and a hinge connecting said shield member to said container along one side thereof, said hinge being an integral part of said container and being formed along a crease and having an incision along a portion of said crease, whereby said hinge allows the shield to be raised by a user from a closed portion in which said shield covers said aperture to retrieve an article therethrough and allowing said shield to automatically resume said closed position thereafter.

28. A device as defined in claim 27 further comprising a spring device for urging said gloves toward the aperture.

29. A glove dispensing comprising:

a box-like container having a top wall, a bottom wall, and four sidewalls therebetween;

an aperture formed through said top wall and at least a first side wall of said container;

a plurality of flattened gloves in said container resting one upon another in a stack having the top and bottom gloves therein parallel to said top wall;

a planar shield member having a width at least as great as the width of the aperture;

a self-acting hinge interconnecting the planar shield member and the container, the hinge positioned such that the planar shield member extends beyond the top wall of the container covering the aperture, and said hinge being an integral part of said container and being formed along a crease and having an incision along a portion of said crease, whereby said hinge allows said shield to automatically rest in a closed position covering said aperture;

a stand adapted for being attached to a vertical surface, said stand including means for holding the container with the top wall thereof at an angle in the range from about 5 degrees to 40 degrees in relation to the vertical surface; and means for removably securing the container to the stand.

* * * * *

UNITED STATES PATENT AND TRADEMARK OFFICE

CERTIFICATE OF CORRECTION

PATENT NO. : 4,997,105

DATED : March 5, 1991

INVENTOR(S) : DAN E. FISCHER

It is certified that error appears in the above-identified patent and that said Letters Patent is hereby corrected as shown below:

Column 1, line 35, "concernig" should be --concern--
Column 2, line 64, "forgoing" should be --foregoing--
Column 7, line 55, "light weight" should be --lightweight--
Column 7, line 59, after "contaminating" insert --the--
Column 7, line 60, delete second occurrence of "the"
Column 8, line 21, "i" should be --in--
Column 8, line 23, "container" should be --container 100--
Column 8, line 25, "thewidth" should be --the width--
Column 12, line 14, "dispensing" should be --dispenser--

Signed and Sealed this

Eighth Day of December, 1992

*Attest:*

DOUGLAS B. COMER

*Attesting Officer*

*Acting Commissioner of Patents and Trademarks*